US008118065B2

(12) United States Patent
Cronburg et al.

(10) Patent No.: US 8,118,065 B2
(45) Date of Patent: Feb. 21, 2012

(54) SAILCLOTH WITH HIGH 1% WARP AND HIGH WARP EFFICIENCY AND METHOD OF MAKING SAME

(75) Inventors: Terry Lee Cronburg, Coventry, CT (US); Robert H. Bainbridge, West Hartford, CT (US)

(73) Assignee: Challenge Sailcloth Inc., Vernon, CT (US)

( * ) Notice: Subject to any disclaimer, the term of this patent is extended or adjusted under 35 U.S.C. 154(b) by 10 days.

(21) Appl. No.: 12/332,262

(22) Filed: Dec. 10, 2008

(65) Prior Publication Data

US 2010/0139540 A1 Jun. 10, 2010

(51) Int. Cl.

| | |
|---|---|
| ***D03D 13/00*** | (2006.01) |
| ***D03D 7/00*** | (2006.01) |
| *D03D 23/00* | (2006.01) |
| *D03D 25/00* | (2006.01) |

(52) U.S. Cl. ..... 139/426 R; 139/383 R; 139/420 R; 139/420 A; 139/DIG. 1

(58) Field of Classification Search ..... 139/383 R, 139/384 R, 386, 420 R, 426 R, 420 A, DIG. 1
See application file for complete search history.

(56) References Cited

U.S. PATENT DOCUMENTS

| | | | | |
|---|---|---|---|---|
| 3,022,545 | A * | 2/1962 | Wydle et al. | 28/267 |
| 3,626,886 | A * | 12/1971 | Cafiero | 114/102.33 |
| 4,590,121 | A * | 5/1986 | Mahr | 442/185 |
| 4,953,489 | A * | 9/1990 | Bassett | 114/102.33 |
| 5,304,414 | A * | 4/1994 | Bainbridge et al. | 442/208 |
| 6,257,160 | B1 | 7/2001 | Keire | |
| 6,722,394 | B2 | 4/2004 | Harrison | |
| 6,725,885 | B2 * | 4/2004 | Mahr | 139/383 R |
| 2002/0164911 | A1 * | 11/2002 | Cunningham et al. | 442/135 |
| 2002/0177377 | A1 * | 11/2002 | Mahr | 442/203 |
| 2003/0111128 | A1 * | 6/2003 | Hannigan et al. | 139/421 |
| 2005/0039662 | A1 * | 2/2005 | Skinner et al. | 114/102.29 |
| 2006/0157138 | A1 | 7/2006 | Cronburg | |
| 2007/0099526 | A1 * | 5/2007 | Heerden et al. | 442/135 |

OTHER PUBLICATIONS

Challenge Sailcloth—6.11 material (identified in the instant application at, e.g., Example 1, paragraphs 41-44, 53-54 and 56-59).
International Search Report for international application No. PCT/US08/86285 issued by the International Searching Authority mailed on Feb. 26, 2009.
Written Opinion of the International Searching Authority for international application No. PCT/US08/86285 issued by the International Searching Authority mailed on Feb. 26, 2009.

* cited by examiner

*Primary Examiner* — Bobby Muromoto, Jr.
(74) *Attorney, Agent, or Firm* — Jeremy C. Lowe

(57) ABSTRACT

A woven sailcloth comprising warp yarns and fill yarns and having one or more of (i) a 1% warp of at least about 125 and/or a warp efficiency of at least about 17, (ii) a plain weave in which the ratio of fill yarn count to warp yarn count is about 1.1:1 to about 1.8:1 and the ratio of warp yarn density to fill yarn density is about 1.2:1 to about 1.9:1, and (iii) a weight of at least about 7 and at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1; a sail comprising panels of sailcloth at least one panel of which is woven sailcloth as described; a method of making such a woven sailcloth comprising weaving warp yarns and fill yarns, which can comprise a reinforcing yarn and can be weaved in a ripstop pattern, in a plain weave in which the ratio of fill yarn count to warp yarn count is about 1.1:1 to about 1.8:1 and the ratio of warp yarn density to fill yarn density is about 1.2:1 to about 1.9:1; and a method of making a sail comprising assembling panels of sailcloth, at least one panel of which is woven sailcloth as described and wherein said at least one panel of woven sailcloth is assembled into the sail with load paths oriented along its warp yarns.

53 Claims, No Drawings

SAILCLOTH WITH HIGH 1% WARP AND HIGH WARP EFFICIENCY AND METHOD OF MAKING SAME

TECHNICAL FIELD

The present disclosure relates to woven sailcloth with high 1% warp and high warp efficiency, as well as a method of making same.

BACKGROUND

"Crimp" is a term that is used to describe the waviness or nonlinearity of yarns in woven fabrics. Typically, such yarns have an "over and under" shape caused by weaving. The more crimp that is present in a woven fabric, the more the fabric will stretch. Stretchiness is an important consideration in the selection of a woven fabric as sailcloth. If sailcloth stretches too much, it loses it shape and is aerodynamically inefficient.

The sail-making industry has attempted to address the issue of crimp in a number of ways. For example, sailcloths have been laminated with one or more layers of nonwoven plastic film to minimize stretching of the sailcloth in the wind. Unfortunately, laminated sailcloths delaminate with age, use, and exposure to the elements. In addition, the laminating film tends to crease and shrink with use, thereby adversely affecting the shape of the sail.

Also, in an effort to minimize stretching, sailcloth, which has been tightly woven from polyester yarns, has been impregnated with a resin and heated to cure the resin and shrink the polyester fabric. In order to construct sails from this sailcloth, numerous panels must be assembled to align the yarns with less crimp along directions of maximum stress or load in the sail so as to reduce stretch. Therefore, the disadvantage of this type of sailcloth is that it limits how panels can be cut and arranged in a sail, while still using the sailcloth efficiently.

Sailcloth also has been constructed with a reinforcing yarn to minimize stretching. The reinforcing yarn, which has a higher tensile modulus (e.g., above 500 grams/denier) than conventional yarn (tensile modulus of 20-100 grams/denier for Dacron or polyester), has been used to replace the conventional yarn every so many yarns in the warp and/or fill direction, while maintaining the denier (see, e.g., Bainbridge et al., U.S. Pat. No. 5,304,414). More recently, sailcloths have been proposed that are woven from heat-shrinkable yarn with crimp imparted to the fill yarns, while leaving the warp yarns relatively uncrimped. Such sailcloths have a ratio of warp density to fill density below 0.93:1 (see, e.g., Mahr, U.S. Pat. No. 6,725,885).

More structured sails have been developed for racing. Fabric strips, which contain bundles of monofilaments, have been taped onto the skin or membrane of the sail along the load path in the sail. However, such sails have proved to have insufficient durability. Consequently, structural sails having a complex secondary structure in which the angles of warp yarns with respect to fill yarns vary in one panel relative to another panel have been proposed (see, e.g., Keire, U.S. Pat. No. 6,257,160). Separately, the use of pre-crimped fill yarn has been proposed to allow for warp yarn to remain predominantly straight with very little crimp (see, e.g., Cronburg, U.S. Pat. App. Pub. No. 2006/0157138).

In view of the above, the present disclosure seeks to provide woven fabric, in particular sailcloth, in which the warp yarns not only remain predominantly straight with very little crimp but also have a high 1% warp and a high warp efficiency. The present disclosure also seeks to provide a method of making same. These and other objects and advantages, as well as inventive features, will become apparent from the detailed description provided herein.

SUMMARY

A woven sailcloth comprising warp yarns and fill yarns is provided. The woven sailcloth has a 1% warp of at least about 125 and/or a warp efficiency of at least about 17.

Another woven sailcloth comprising warp yarns and fill yarns is also provided. The warp yarns and fill yarns are weaved in a plain weave in which the ratio of fill yarn count to warp yarn count is about 1.1:1 to about 1.8:1, and the ratio of warp yarn density to fill yarn density is about 1.2:1 to about 1.9:1. The woven sailcloth has a 1% warp of at least about 125 and/or a warp efficiency of at least about 17.

Yet another woven sailcloth comprising warp yarns and fill yarns is provided. The woven sailcloth has a weight of at least about 7 and at least one of: a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1.

Still yet another woven sailcloth comprising warp yarns and fill yarns is provided. The woven sail sailcloth has a weight of at least about 7. The warp yarns and fill yarns are weaved in a plain weave in which the ratio of fill yarn count to warp yarn count is about 1.1:1 to about 1.8:1, and the ratio of warp yarn density to fill yarn density is about 1.2:1 to about 1.9:1. The woven sailcloth has a 1% warp of at least about 125 and/or a warp efficiency of at least about 17. The woven sailcloth also has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1.

Further provided is a sail comprising panels of sailcloth at least one of which is woven sailcloth as described herein. Desirably, the at least one panel of woven sailcloth as described herein is assembled into the sail with load paths oriented along its warp yarns.

Still further provided is a method of making a woven sailcloth comprising warp yarns and fill yarns. The method comprises weaving warp yarns and fill yarns in a plain weave in which the ratio of fill yarn count to warp yarn count is about 1.1:1 to about 1.8:1 and the ratio of warp yarn density to fill yarn density is about 1.2:1 to about 1.9:1.

Even still further provided is a method of making a sail. The method comprises assembling panels of sailcloth, at least one panel of which is woven sailcloth as described herein and which is assembled into the sail with load paths oriented along its warp yarns.

DETAILED DESCRIPTION

The present disclosure is predicated on the surprising and unexpected discovery that in a heavier woven sailcloth wherein the warp yarns are predominantly straight with very little crimp the woven sailcloth has a high 1% warp and a high warp efficiency. The woven sailcloth also has other superior characteristics.

The following terms are relevant to the present disclosure:

(a) "Yarn" and "yarns" are used herein to refer to any and all fibers, filaments, strands, and/or yarns of natural, synthetic, or composite (e.g., natural and synthetic) material that can be woven into a fabric, in particular sailcloth.

(b) "Warp" describes a yarn that runs lengthwise in a fabric.

(c) "Weft" describes a yarn that runs widthwise in a fabric. This yarn also may be referred to as a "fill" yarn.

(d) "Woven" describes a fabric that is made by weaving warp and fill yarns together, such as by operation of a loom. The warp and fill yarns cross over and under each other as the fabric is woven.

(e) "Crimp" describes the waviness or nonlinearity of yarns in woven fabrics (see, e.g., *Man-Made Fiber and Textile Dictionary*, Celanese Corporation). Crimp can occur in the warp and/or weft yarns. Factors, such as the relative thickness ("denier") of the yarns and the tension of the yarns, can affect crimp. A thinner yarn (lower denier) will crimp more than a thicker yarn (higher denier). Likewise, a yarn under less tension will crimp more than a yarn under more tension. Crimp can be measured by making gage marks on a woven fabric a set distance apart. For example, marks can be made about one meter apart along the length of the fabric. A warp yarn between two gage marks is then unraveled. The unraveled yarn is straightened out, and its length is measured. The length of the unraveled yarn in excess of the gage (in this example, in excess of one meter) is a measure of the crimp. If, for example, the unraveled warp yarn is 1.15 meters in length, it has a 15% crimp. The crimp in a weft yarn can be similarly measured between gage marks marked on a woven fabric a set distance apart along the width of the fabric.

(f) "Denier" is the weight in grams of a 9,000 meter length of yarn. The denier is proportional to the square of the effective diameter of the yarn.

(g) "Average denier" is [(a)(b)+(c)(d)]/(b+d), wherein "a" and "c" are the number of threads of denier "b" and "d," respectively.

(h) "Plain weave" describes a manner of weaving in which warp yarns pass over and under weft (or fill) yarns.

(i) "Ripstop" describes a woven fabric in which a reinforcing yarn has been used at a designated interval, which can vary from one fabric to another and, if desired, within a single fabric. Depending on how the reinforcing yarn is incorporated, the woven fabric can take on a variety of textures, such as a box pattern. The presence of the reinforcing yarn makes the fabric difficult to rip; hence, the term "ripstop."

(j) "Density" of a fabric is determined by multiplying the square root of the yarn in denier by the yarn count per inch.

(k) "Greige" refers to a woven fabric in an unfinished state.

(l) "Bias" refers to the direction of the fabric at 45° from the warp direction or the fill direction.

(m) "1% warp" refers to the amount of weight (in pounds) that must be applied to woven fabric for the warp yarns to stretch or elongate 1%.

(n) "10 lb. warp" is the number of hundredths of an inch that warp yarn elongates under 10 lbs. of force. A 2 inch×16 inch sample of woven fabric is stretched with 10 lbs. of force in the 16-inch direction, and the elongation of the warp yarn is measured.

(o) "10 lb. fill" is the number of hundredths of an inch that fill yarn elongates under 10 lbs. of force. A 2 inch×16 inch sample of woven fabric is stretched with 10 lbs. of force in the 16-inch direction, and the elongation of the fill yarn is measured.

(p) "10 lb. bias" is the number of hundredths of an inch that woven fabric elongates along its bias under 10 lbs. of force. A 2 inch×16 inch sample of woven fabric, which has been cut along its bias, is stretch with 10 lbs. of force in the 16-inch direction, and the elongation of the fabric is measured.

(q) "50 lb. warp" is the number of hundredths of an inch that warp yarn elongates under 50 lbs. of force. A 2 inch×16 inch sample of woven fabric is stretched with 50 lbs. of force in the 16-inch direction, and the elongation of the warp yarn is measured.

(r) The "weight" of woven fabric is measured in ounces per sailmaker yard, which is 36 inches×28.5 inches.

(s) "Efficiency" is a term used to describe the ability of a woven fabric having a given weight to resist stretching. For example, if a woven fabric resists stretching but weighs a lot, it is considered to be relatively inefficient, or to have low efficiency. By contrast, if a woven fabric resists stretching and does not weigh a lot, it is considered to be relatively efficient, or to have relatively high efficiency.

(t) "Warp efficiency"=1% warp/weight.

(u) "1% W:1% F" is the ratio of 1% warp to 1% fill.

(v) "1% F:1% B" is the ratio of 1% fill to 1% bias.

(w) "1% W:1% F::1% F:1% B" is the ratio of 1% W:1% F to 1% F:1% B.

(x) "10#W:10#F" is the ratio of 10 lb. warp to 10 lb. fill.

(y) "10#F:10#B" is the ratio of 10 lb. fill to 10 lb. bias.

(z) "10#W:10#F::10#F:10#B" is the ratio of 10#W:10#F to 10#F:10#B.

The above terminology may be used herein to describe one or more aspects of the present disclosure. The terminology is not intended to limit the scope of the claimed invention.

A woven sailcloth comprising warp yarns and fill yarns is provided. The woven sailcloth comprising warp yarns and fill yarns can have a weight of at least about 6, such as 6.39. Accordingly, the woven sailcloth can have a weight of at least about 6.5, at least about 7, at least about 7.5, at least about 8, at least about 8.5, at least about 9, at least about 9.5, or at least about 10. In a preferred embodiment of the invention, the woven sailcloth has a weight of 7.94. In another preferred embodiment of the invention, the woven sailcloth has a weight of 9.78.

In a preferred embodiment, the woven sailcloth has a 1% warp of at least about 125. Accordingly, the woven sailcloth can have a 1% warp of at least about 125, at least about 130, at least about 135, at least about 140, at least about 145, at least about 150, at least about 155, at least about 160, at least about 165, at least about 170, at least about 175, at least about 180, at least about 185, at least about 190, at least about 195, at least about 200, and at least about 205. The woven sailcloth also preferably has a warp efficiency of at least about 17. Accordingly, the woven sailcloth can have a warp efficiency of at least about 17, at least about 18, at least about 19, at least about 20, and at least about 21. In a preferred embodiment, the woven sailcloth has a 1% warp of at least about 125 (e.g., at least about 140) and/or a warp efficiency of at least about 17. In another preferred embodiment, the woven sailcloth has a 1% warp of at least about 190 (e.g., at least about 205) and/or a warp efficiency of at least about 21. Preferably, the woven sailcloth also has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1. Preferably, the sailcloth has a weight of at least about 7, more preferably at least about 9. Preferably, the warp yarns and the fill yarns are weaved in a plain weave in which the ratio of fill yarn count to warp yarn count is about 1.1:1 to about 1.8:1, and the ratio of warp yarn density to fill yarn density is about 1.2:1 to about 1.9:1.

In another preferred embodiment, the woven sailcloth comprises warp yarns and fill yarns that are weaved in a plain weave in which the ratio of fill yarn count to warp yarn count is about 1.1:1 to about 1.8:1, and the ratio of warp yarn density to fill yarn density is about 1.2:1 to about 1.9:1. The woven sailcloth has a 1% warp of at least about 125, more preferably at least about 190, and/or a warp efficiency of at least about 17, more preferably at least about 21. The woven sailcloth preferably has a weight of at least about 7, more preferably at least about 9. In addition, the woven sailcloth preferably has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1.

In yet another preferred embodiment, the woven sailcloth has a weight of at least about 7 and one or more (such as two, three, four, five, six, seven, eight or all) of the following: a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp: 10 lb. fill to 10 lb. fill:10 lb. bias ratio of less than about 0.5:1. Preferably, the woven sailcloth has a 1% warp of at least about 125 (e.g., at least about 140) and/or a warp efficiency of at least about 17; more preferably, the woven sailcloth has a 1% warp of at least about 190 (e.g., at least about 205) and/or a warp efficiency of at least about 21. Preferably, the woven sailcloth has a weight of at least about 9. Preferably, the warp yarns and fill yarns that are weaved in a plain weave in which the ratio of fill yarn count to warp yarn count is about 1.1:1 to about 1.8:1, and the ratio of warp yarn density to fill yarn density is about 1.2:1 to about 1.9:1.

In still yet another preferred embodiment, the woven sailcloth has a weight of at least about 7 and comprises warp yarns and fill yarns weaved in a plain weave in which the ratio of fill yarn count to warp yarn count is about 1.1:1 to about 1.8:1 and the ratio of warp yarn density to fill yarn density is about 1.2:1 to about 1.9:1. The woven sailcloth has a 1% warp of at least about 125 and/or a warp efficiency of at least about 17. The woven sailcloth has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1. Preferably, the weight of the woven sailcloth is at least about 9, and the woven sailcloth has a 1% warp of at least about 190 and/or a warp efficiency of at least about 21.

The woven sailcloth comprising warp yarns and fill yarns can have a 1% warp to 1% fill ratio of at least about 4.9:1. The 1% warp to 1% fill ratio can be as high as about 24:1, such as 24:1. Accordingly, the woven sailcloth can have a 1% warp to 1% fill ratio of at least about 5:1, at least about 6:1, at least about 7:1, at least about 8:1, at least about 9:1, at least about 10:1, at least about 11:1, at least about 12:1, at least about 13:1, at least about 14:1, at least about 15:1, at least about 16:1, at least about 17:1, at least about 18:1, at least about 19:1, at least about 20:1, at least about 21:1, at least about 22:1, or at least about 23:1.

The woven sailcloth comprising warp yarns and fill yarns can have a 1% fill to 1% bias ratio of less than about 0.8:1, such as 0.74:1. The 1% fill to 1% bias ratio can be as low as about 0.62:1, such as about 0.67:1, or even lower. Accordingly, the woven sailcloth can have a 1% fill to 1% bias ratio of less than about 0.7:1, less than about 0.6:1, or less than about 0.5:1.

The woven sailcloth comprising warp yarns and fill yarns can have a 1% warp:1% fill to 1% fill:1% bias ratio of at least about 7:1, such as 7.33:1. The 1% warp:1% fill to 1% fill:1% bias ratio can be as high as about 33:1, such as 32.47:1, or even higher. The 1% warp 1% fill to 1% fill:1% bias ratio can be 21.59:1, for example. Accordingly, the woven sailcloth can have a 1% warp:1% fill to 1% fill:1% bias ratio of at least about 8:1, at least about 9:1, at least about 10:1, at least about 11:1, at least about 12:1, at least about 13:1, at least about 14:1, at least about 15:1, at least about 16:1, at least about 17:1, at least about 18:1, at least about 19:1, at least about 20:1, at least about 21:1, at least about 22:1, at least about 23:1, at least about 24:1, at least about 25:1, at least about 26:1, at least about 27:1, at least about 28:1, at least about 29:1, at least about 30:1, at least about 31:1, or at least about 32:1.

The woven sailcloth comprising warp yarns and fill yarns can have a 10 lb. warp to 10 lb. fill ratio of less than about 0.5:1, such as 0.44:1. The 10 lb. warp to 10 lb. fill ratio can be as low as about 0.07:1, such as about 0.09:1, or even lower. Accordingly, the woven sailcloth can have a 10 lb. warp to 10 lb. fill ratio of less than about 0.4:1, less than about 0.3:1, less than about 0.2:1, less than about 0.1:1, less than about 0.09:1, less than about 0.08:1, less than about 0.07:1, less than about 0.06:1, or less than about 0.05:1.

The woven sailcloth comprising warp yarns and fill yarns can have a 10 lb. fill to 10 lb. bias ratio of at least about 1.1:1, such as 1.12:1. The 10 lb. fill to 10 lb. bias ratio can be as high as about 2.5:1, such as at least about 1.5:1, or even higher. Accordingly, the woven sailcloth can have a 10 lb. fill to 10 lb. bias ratio of at least about 1.2:1, at least about 1.3:1, at least about 1.4:1, at least about 1.5:1, at least about 1.6:1, at least about 1.7:1, at least about 1.8:1, at least about 1.9:1, at least about 2.0:1, at least about 2.1:1, at least about 2.2:1, at least about 2.3:1, at least about 2.4:1 or at least about 2.5:1.

The woven sailcloth comprising warp yarns and fill yarns can have a 10 lb. warp:10 lb. fill to 10 lb. fill:10 lb. bias ratio of less than about 0.4:1, such as 0.39:1. The woven sailcloth can have a 10 lb. warp:10 lb. fill to 10 lb. fill:10 lb. bias ratio of less than about 0.06:1, such as less than about 0.03:1, or even lower. Accordingly, the woven sailcloth can have a 10 lb. warp:10 lb. fill to 10 lb. fill:10 lb. bias ratio of less than about 0.5:1, less than about 0.4:1, less than about 0.3:1, less than about 0.2:1, less than about 0.1:1, less than about 0.09:1, less than about 0.08:1, less than about 0.07:1, less than about 0.06:1, less than about 0.05:1, less than about 0.04:1, or less than about 0.03:1.

Any suitable yarn can be used. Examples of suitable yarns include, but are not limited to, polyester yarn, such as a Dacron-type polyester yarn, and polyamide yarn, such as a nylon yarn. Preferably, the fill yarns are pre-crimped and stretchable (see, e.g., Cronburg, U.S. Pat. App. Pub. No. 2006/0157138, incorporated herein by reference; see also, Smith et al., U.S. Pat. No. 5,771,674 for a method of crimping fibers, also incorporated herein by reference).

The denier of a warp yarn preferably ranges from about 500 to about 1,500. Therefore, the denier of a warp yarn can be about 550, about 575, about 600, about 625, about 650, about 675, about 700, about 725, about 750, about 775, about 800, about 825, about 850 (such as 840), about 875, about 900, about 925, about 950, about 975, about 1,000, about 1,025, about 1,050, about 1,075, about 1,100, about 1,125, about 1,150, about 1,175, about 1,200, about 1,225, about 1,250, about 1,275, about 1,300, about 1,325, about 1,350, about 1,375, about 1,400, about 1,425, about 1,450, about 1,475, or about 1,500. The denier of a weft/fill yarn preferably ranges from about 150 to about 350. Therefore, the denier of a weft/fill yarn can be about 150, about 155 (such as about 157), about 160, about 165, about 170 (such as about 171.88 or 172), about 175, about 180, about 185, about 190, about 195, about 200, about 205, about 210, about 215, about 220, about 225, about 230, about 235, about 240, about 245, about 250, about 255, about 260, about 265, about 270, about 275, about 280, about 285, about 290, about 295, about 300, about 305, about 310, about 315 (such as about 313.33 or 313), about 320, about 325, about 330, about 335, about 340, about 345, or about 350.

In this regard, the denier of a weft/fill yarn can be achieved by weaving a lower denier yarn in combination with a higher denier yarn such that an effective denier in the preferred range is achieved. For example, a fill yarn of 150 denier can be weaved with a fill yarn of 220 denier. If nine yarns of 150 denier are weaved with one yarn of 220 denier, an effective average denier of 157, which is within the preferred range, can be achieved. Similarly, a fill yarn of 150 denier can be weaved with a fill yarn of 500 denier. If 15 yarns of 150 denier are weaved with one yarn of 500 denier, an effective average denier of 171.88, which is within the preferred range, can be achieved. Similarly, two or more yarns can be combined as a single yarn for weaving. For example, two fill yarns of 150 denier can be weaved together as one, resulting in a denier of 300. The resulting fill yarn having a denier of 300 can be weaved with a fill yarn of 500 denier. If 14 fill yarns of 300 denier are weaved with one fill yarn of 500 denier, an effective average denier of 313.33, which is within the preferred range, can be achieved. One of ordinary skill in the art will readily appreciate that numerous other combinations of deniers and combinations of yarn counts (i.e., number of yarns of one denier woven with number of yarns of another denier) can result in a denier or average denier within the preferred range.

Preferably, the ratio of fill yarn count (yarns/inch) to warp yarn count (yarns/inch) is about 1.1:1 to about 1.8:1. Thus, the ratio of fill yarn count to warp yarn count can be about 1.1:1, about 1.2:1, about 1.3:1, about 1.4:1, about 1.5:1, about 1.6:1, about 1.7:1 or about 1:8:1. The ratio of fill yarn count to warp yarn count can be from about 1.1:1 to about 1.7:1, about 1.1:1 to about 1.6:1, about 1.1:1 to about 1.5:1, about 1.1:1 to about 1.4:1, about 1.1:1 to about 1.3:1, or about 1.1:1 to about 1.2:1.

Preferably, the average warp yarn density is about 1,300 to about 1,700. Thus, the average warp yarn density can be about 1,325, about 1,350, about 1,375, about 1,400, about 1,425, about 1,450, about 1,475, about 1,500, 1,525, about 1,550, about 1,575, about 1,600, about 1,625, about 1,650, about 1,675 or about 1,700.

Preferably, the concurrent average weft/fill yarn density is about 800 to about 1,300. Thus, the average weft/fill yarn density can be about 825, about 850, about 875, about 900, about 925, about 950, about 975, about 1,000, about 1,025, about 1,050, about 1,075, about 1,100, about 1,125, about 1,150, about 1,175, about 1,200, about 1,225, about 1,250, about 1,275 or about 1,300.

Preferably, the ratio of warp yarn density to fill yarn density is about 1:1 to about 2:1. Thus, the ratio of average warp yarn density to average fill yarn density can be about 1:1, about 1.1:1, about 1.2:1, about 1.3:1, about 1.4:1, about 1.5:1, about 1.6:1, about 1.7:1, about 1:8:1, about 1.9:1 or about 2:1. The ratio of warp yarn density to fill yarn density can be from about 1.1:1 to about 1.9:1, from about 1.2:1 to about 1.9:1, from about 1.3:1 to about 1.9:1, about 1.4:1 to about 1.9:1, about 1.5:1 to about 1.9:1, about 1.6:1 to about 1.9:1, about 1.7:1 to about 1.9:1, or about 1.8:1 to about 1.9:1.

The warp yarns and fill yarns can be weaved into any suitable weave. The fill yarns are preferably pre-crimped. A preferred weave is a plain weave. In this regard, it is preferred that a reinforcing yarn (i.e., a yarn of a higher denier) is used with the fill yarn, such as every $n^{th}$ yarn, wherein "n" is preferably an integer from and including 5 to and including 20, such as 5, 6, 7, 8, 9, 10, 11, 12, 13, 14, 15, 16, 17, 18, 19, or 20. An "n" of 10, 14 or 15 can be preferred. By incorporating a reinforcing yarn, the fill yarns can be weaved in a ripstop pattern, which is preferred.

Preferably, the woven sailcloth is used in the construction of sails. Therefore, provided is a sail comprising panels of sailcloth at least one of which is a panel of woven sailcloth as described herein. The at least one panel of woven sailcloth as described herein is assembled into the sail with load paths oriented along its warp yarns.

Accordingly, also provided is a method of making a woven sailcloth comprising warp yarns and fill yarns. The method comprises weaving warp yarns and fill yarns in a plain weave in which the ratio of fill yarn count to warp yarn count is about 1.1:1 to about 1.8:1 and the ratio of warp yarn density to fill yarn density is about 1.2:1 to about 1.9:1. Preferably, the fill yarns are pre-crimped. The fill yarns preferably comprise a reinforcing yarn. Preferably, the reinforcing yarn is present every $n^{th}$ yarn, wherein "n" is an integer from and including 5 to and including 20, such as 5, 6, 7, 8, 9, 10, 11, 12, 13, 14, 15, 16, 17, 18, 19, or 20. An "n" of 10, 14 or 15 can be preferred. The fill yarns are preferably weaved in a ripstop pattern.

The woven sailcloth can be finished in accordance with methods known in the art. For example, it can be scoured (e.g., to remove any sizing, wax, dirt, and the like). Afterwards, it can be dipped into an aqueous bath of heat-curable resin, such as melamine, which serves to lock the woven geometry and decrease stretch. The fabric then can be dried and heat-set by passing through an oven or over large, heated, metal cylinders, such as cylinders heated to about 425° F., which causes the yarns to shrink, thereby increasing density. The fabric then can be calendared by passing the fabric between a pair of rollers under high pressure (e.g., 70 tons), with one of the rollers being heated. Instead of being heat-set with melamine, the fabric can be coated with polyurethane or the like. Afterwards, the edges of the fabric are typically slit, and the fabric is tubed off into rolls. These finishing methods are exemplary and are not intended to be limiting.

In view of the foregoing, a method of making a sail is also provided. The method comprises assembling panels of sailcloth, at least one panel of which is woven sailcloth as described herein. The at least one panel of woven sailcloth as described herein is assembled into the sail with load paths oriented along its warp yarns.

EXAMPLES

The following examples serve to illustrate the present disclosure. The examples are not intended to be limiting.

Example 1

This example describes a construction of sailcloth referred to as 6.11.

This sailcloth was constructed from 500 denier warp yarn and a mixture of 150 and 220 denier fill yarns. The fill yarns were woven in a repeating pattern of nine 150 denier yarns followed by one 220 denier yarn. This resulted in an average fill denier of 157. The yarns were weaved in a plain weave with a ripstop pattern in the fill yarn.

The griege fabric contained 62 yarns/inch in the warp and, based on the average fill denier, 85 yarns/inch in the fill. The density of the warp was 1,386, whereas the average density of the fill was 1,065.

The finished fabric contained 75 yarns/inch in the warp, 78.55 yarns/inch in the 150 denier fill, and 8.73 yarns/inch in the 220 denier fill (i.e., a total of 87.28 yarns/inch in the fill). The density of the warp was 1,677, whereas the average density of the fill was 1,093.

Example 2

This example describes a construction of sailcloth referred to as 8.11.

This sailcloth was constructed from 840 denier warp yarn and 150 and 500 denier fill yarns. The fill yarns were woven in a repeating pattern of 15 150 denier yarns followed by one 500 denier yarn. This resulted in an average fill denier of 171.88. The yarns were weaved in a plain weave with a ripstop pattern in the fill yarn.

The griege fabric contained 44 yarns/inch in the warp and, based on the average fill denier, 80 yarns/inch in the fill. The density of the warp was 1,275, whereas the average density of the fill was 1,049.

The finished fabric contained 55 yarns/inch in the warp, 78.75 yarns/inch in the 150 denier fill, and 5.25 yarns/inch in the 500 denier fill (i.e., a total of 84 yarns/inch in the fill). The density of the warp was 1,594, whereas the average density of the fill was 1,011.

Example 3

This example describes a construction of sailcloth referred to as 10.11.

This sailcloth was constructed from 1,500 denier warp yarn and 150 and 500 denier fill yarns. In this example, however, two 150 denier yarns were weaved together as one, resulting in fill deniers of 300 and 500. The fill yarns were woven in a repeating pattern of 14 300 denier yarns followed by one 500 denier yarn. This resulted in an average fill denier of 313.33. The yarns were weaved in a plain weave with a ripstop pattern in the fill yarn.

The griege fabric contained 41 yarns/inch in the warp and, based on the average fill denier, 47.5 yarns/inch in the fill. The density of the warp was 1,588, whereas the average density of the fill was 841.

The finished fabric contained 43 yarns/inch in the warp, 46.22 yarns/inch in the 300 denier fill, and 3.3 yarns/inch in the 500 denier fill (i.e., a total of 49.52 yarns/inch in the fill). The density of the warp was 1,665, whereas the average density of the fill was 877.

For ease of comparison, the specifications of Examples 1-3 are summarized in Tables 1 to 3.

TABLE 1

| Weave | | |
|---|---|---|
| Fabric | Warp (denier) | Fill (average denier) |
| 6.11 | 500 | 157 |
| 8.11 | 840 | 171.88 |
| 10.11 | 1,500 | 313.33 |

TABLE 2

| Griege Fabric | | | | |
|---|---|---|---|---|
| Fabric | Warp Yarn Count (yarns/inch) | Warp Density | Fill Yarn Count (yarns/inch) | Fill Density |
| 6.11 | 62 | 1,386 | 85 | 1,065 |
| 8.11 | 44 | 1,275 | 80 | 1,049 |
| 10.11 | 41 | 1,588 | 47.5 | 841 |

TABLE 3

| Finished Fabric | | | | |
|---|---|---|---|---|
| Fabric | Warp Yarn Count (yarns/inch) | Warp Density | Fill Yarn Count (yarns/inch) | Fill Density |
| 6.11 | 75 | 1,677 | 87.28 | 1,093 |
| 8.11 | 55 | 1,594 | 84 | 1,011 |
| 10.11 | 43 | 1,665 | 49.52 | 877 |

As can be seen in Tables 1 to 3, the denier of the warp yarn was higher than that of the fill yarn in all three sailcloths. In addition, the warp yarn count was lower than the fill yarn count in all three sailcloths. The ratio of fill yarn count to warp yarn count ranged from about 1.1:1 to about 1.8:1. The warp density was higher than the fill density in all three sailcloths. The ratio of warp density to fill density ranged from about 1.2:1 to about 1.9:1.

Example 4

This example compares the sailcloths of Examples 1-3 with other commercially available sailcloths.

The sailcloths of Examples 1-3 were compared to numerous other sailcloths, including Challenge 4.1 Radial (Challenge Sailcloth, Vernon, Conn.), Challenge 5.1 Radial (Challenge Sailcloth), Challenge 5.51 Radial (Challenge Sailcloth), Challenge 6.51 Radial (Challenge Sailcloth), Challenge 7.1 Radial (Challenge Sailcloth), Challenge 8.1 Radial (Challenge Sailcloth), Challenge 9.1 Radial (Challenge Sailcloth), Contender 5.5 Radial (Contender Sailcloth, Fall River, Mass.), Contender 6.5 Radial (Contender Sailcloth), Contender 7.5 Radial (Contender Sailcloth), Contender 8.5 Radial (Contender Sailcloth), Contender 8.01 Warp (Contender Sailcloth), Contender 5.5 Polypreg (Contender Sailcloth), Contender 6.5 Polypreg (Contender Sailcloth), Contender 7.5 Polypreg (Contender Sailcloth), Contender 8.5 Polypreg (Contender Sailcloth), Contender 9.5 Polypreg (Contender Sailcloth), Contender 10.5 Polypreg (Contender Sailcloth), Contender 9 Ultraweave (Contender Sailcloth), North 8.8 Premium Nordac (North Sails Group, Milford, Conn.), and North 12.8 (North Sails Group) sailcloths. The 1% warp, 1% fill, 1% bias, 10 lb. warp, 10 lb. fill, 10 lb. bias, 50 lb. warp, weight, and warp efficiency of each sailcloth were measured. The data are set forth in Table 4.

TABLE 4

| Sailcloth | 1% warp | 1% fill | 1% bias | 10 lb. warp | 10 lb. fill | 10 lb. bias | 50 lb. warp | weight | warp efficiency |
|---|---|---|---|---|---|---|---|---|---|
| Challenge 4.1 Radial | 64 | 39.5 | 21.5 | 2.5 | 3.5 | 7 | 13 | 4.20 | 15.2 |
| Challenge 5.1 Radial | 48.5 | 41 | 20 | 3.5 | 3.5 | 7 | 16.5 | 4.67 | 10.4 |

TABLE 4-continued

| Sailcloth | 1% warp | 1% fill | 1% bias | 10 lb. warp | 10 lb. fill | 10 lb. bias | 50 lb. warp | weight | warp efficiency |
|---|---|---|---|---|---|---|---|---|---|
| Challenge 5.51 Radial | 62 | 36 | 20 | 2.5 | 3.5 | 7.5 | 13.5 | 5.78 | 10.7 |
| Challenge 6.51 Radial | 62 | 58 | 24 | 3 | 3 | 6.5 | 13.5 | 6.17 | 10.0 |
| Challenge 7.1 Radial | 51 | 80 | 28 | 3 | 2 | 5 | 15 | 7.20 | 7.1 |
| Challenge 8.1 Radial | 42.5 | 76 | 17.5 | 4 | 2 | 9 | 19 | 7.97 | 5.3 |
| Challenge 9.1 Radial | 98 | 62.5 | 31.5 | 2 | 2.5 | 5 | 8.5 | 8.56 | 11.4 |
| Contender 5.5 Radial | 35 | 52.2 | 17.09 | 4.2 | 2.52 | 8.9 | — | 5.43 | 6.4 |
| Contender 6.5 Radial | 53.1 | 55.54 | 26.25 | 2.84 | 2.46 | 5.74 | — | 6.65 | 8.0 |
| Contender 7.5 Radial | 42.3 | 53.7 | 17.3 | 4.4 | 2.6 | 9.9 | — | 7.93 | 5.3 |
| Contender 8.5 Radial | 47.4 | 58.6 | 16.2 | 3.86 | 2.64 | 9.74 | — | 8.84 | 5.4 |
| Contender 9.5 Radial | 60.7 | 60.4 | 14.4 | 3.4 | 2.6 | 11.1 | — | 9.80 | 6.2 |
| Contender 8.01 Warp | 59 | 20.2 | — | 3.3 | 5.8 | 7.8 | 14.9 | 8.03 | 7.3 |
| Contender 5.5 Polypreg | 47.6 | 42.8 | 16.6 | 3.2 | 3.1 | 9.1 | 16.9 | 4.87 | 9.8 |
| Contender 6.5 Polypreg | 32.3 | 45.5 | 13.4 | 6.2 | 2.9 | 12 | 24 | 6.72 | 4.8 |
| Contender 7.5 Polypreg | 54.6 | 40.3 | 19.2 | 2.8 | 3.3 | 7.8 | 14.5 | 7.21 | 7.6 |
| Contender 8.5 Polypreg | 61.7 | 54.9 | 16.8 | 2.9 | 2.2 | 9.7 | 13 | 8.23 | 7.5 |
| Contender 9.5 Polypreg | 40 | 58.6 | 12.1 | 6.6 | 3.1 | 13.7 | 18.8 | 9.59 | 4.2 |
| Contender 10.5 Polypreg | 40 | 60.9 | 18.2 | 5.8 | 1.8 | 9 | 18.8 | 11.57 | 3.5 |
| Contender 9 Ultraweave | 117 | 57.5 | 15 | 1.5 | 2.4 | 7.5 | 6.4 | 8.01 | 14.6 |
| North 8.8 Premium Nordac | 27.5 | 110 | 17.5 | 6 | 1.5 | 9 | 29.5 | 8.71 | 3.2 |
| North 12.8 | 39.5 | 164 | 23 | 4.5 | 1 | 6.5 | 10.5 | 13.20 | 3.0 |
| 6.11 (Ex. 1) | 88 | 18 | 27 | 2 | 4.5 | 4 | 7.5 | 6.39 | 13.8 |
| 8.11 (Ex. 2) | 140 | 10.5 | 17 | 1 | 15 | 6 | 5 | 7.94 | 17.6 |
| 10.11 (Ex. 3) | 204 | 8.5 | 11.5 | 1.5 | 16.5 | 11 | 6.4 | 9.78 | 20.9 |

As can be seen in Table 4, while the weight of the sailcloth increases from 6.11 to 8.11 to 10.11, 1% warp and warp efficiency also increase. This finding is surprising and unexpected inasmuch as 1% warp and warp efficiency tend to remain relatively constant or decrease with increasing weight. Also, the 8.11 and 10.11 had the highest 1% warps and the highest warp efficiencies in comparison to the other sailcloths, even the lower weight sailcloths.

The ratio of 1% warp to 1% fill, the ratio of 1% fill to 1% bias, the ratio of 1% warp:1% fill to the ratio of 1% fill:1% bias, the ratio of 10 lb. warp to 10 lb. fill, the ratio of 10 lb. fill to 10 lb. bias, and the ratio of 10 lb. warp:10 lb. fill to the ratio of 10 lb. fill:10 lb. bias of the sailcloths were also measured. The data are set forth in Table 5.

TABLE 5

| Sailcloth | 1% W:1% F | 1% F:1% B | 1% W:1% F::1% F:1% B | 10#W:10#F | 10#F:10#B | 10#W:10#F::10#F:10#B |
|---|---|---|---|---|---|---|
| Challenge 4.1 Radial | 1.62:1 | 1.84:1 | 0.88:1 | 0.71:1 | 0.50:1 | 1.43:1 |
| Challenge 5.1 Radial | 1.18:1 | 2.05:1 | 0.58:1 | 1:1 | 0.50:1 | 2:1 |
| Challenge 5.51 Radial | 1.72:1 | 1.80:1 | 0.96:1 | 0.71:1 | 0.47:1 | 1.53:1 |
| Challenge 6.51 Radial | 1.07:1 | 2.42:1 | 0.44:1 | 1:1 | 0.46:1 | 2.17:1 |
| Challenge 7.1 Radial | 0.64:1 | 2.86:1 | 0.22:1 | 1.5:1 | 0.40:1 | 3.75:1 |
| Challenge 8.1 Radial | 0.56:1 | 4.34:1 | 0.13:1 | 2:1 | 0.22:1 | 9:1 |
| Challenge 9.1 Radial | 1.57:1 | 1.98:1 | 0.79:1 | 0.80:1 | 0.50:1 | 1.6:1 |
| Contender 5.5 Radial | 0.67:1 | 3.05:1 | 0.22:1 | 1.67:1 | 0.28:1 | 5.89:1 |
| Contender 6.5 Radial | 0.96:1 | 2.12:1 | 0.45:1 | 1.15:1 | 0.43:1 | 2.69:1 |
| Contender 310 HTP-SQ Weave | 1.10:1 | 1.64:1 | 0.67:1 | 0.76:1 | 0.66:1 | 1.15:1 |
| Contender 7.5 Radial | 0.79:1 | 3.10:1 | 0.25:1 | 1.69:1 | 0.26:1 | 6.44:1 |
| Contender 8.5 Radial | 0.81:1 | 3.62:1 | 0.22:1 | 1.46:1 | 0.27:1 | 5.39:1 |
| Contender 9.5 Radial | 1.00:1 | 4.19:1 | 0.24:1 | 1.31:1 | 0.23:1 | 5.58:1 |
| Contender 8.01 Warp | 2.92:1 | — | — | 0.57:1 | 0.74:1 | 0.76:1 |
| Contender 5.5 Polypreg | 1.11:1 | 2.58:1 | 0.43:1 | 1.03:1 | 0.34:1 | 3.03:1 |

TABLE 5-continued

| Sailcloth | 1% W:1% F | 1% F:1% B | 1% W:1% F::1% F:1% B | 10#W:10#F | 10#F:10#B | 10#W:10#F::10#F:10#B |
|---|---|---|---|---|---|---|
| Contender 6.5 Polypreg | 0.71:1 | 3.40:1 | 0.21:1 | 2.14:1 | 0.24:1 | 8.85:1 |
| Contender 7.5 Polypreg | 1.36:1 | 2.10:1 | 0.64:1 | 0.85:1 | 0.42:1 | 2.01:1 |
| Contender 8.5 Polypreg | 1.12:1 | 3.27:1 | 0.34:1 | 1.32:1 | 0.23:1 | 5.81:1 |
| Contender 9.5 Polypreg | 0.68:1 | 4.84:1 | 0.14:1 | 2.13:1 | 0.23:1 | 9.41:1 |
| Contender 10.5 Polypreg | 0.66:1 | 3.35:1 | 0.20:1 | 3.22:1 | 0.20:1 | 1.61:1 |
| Contender 9 Ultraweave | 2.04:1 | 3.83:1 | 0.53:1 | 0.62:1 | 0.32:1 | 1.95:1 |
| North 8.8 Premium Nordac | 0.25:1 | 6.29:1 | 0.04:1 | 4:1 | 0.17:1 | 24:1 |
| North 12.8 | 0.24:1 | 7.13:1 | 0.03:1 | 4.5:1 | 0.15:1 | 29.2:1 |
| 6.11 (Ex. 1) | 4.89:1 | 0.67:1 | 7.33:1 | 0.44:1 | 1.12:1 | 0.39:1 |
| 8.11 (Ex. 2) | 13.33:1 | 0.62:1 | 21.59:1 | 0.07:1 | 2.5:1 | 0.03:1 |
| 10.11 (Ex. 3) | 24:1 | 0.74:1 | 32.47:1 | 0.09:1 | 1.5:1 | 0.06:1 |

As can be seen in Table 5, the comparative sailcloths had a 1% warp to 1% fill ratio that ranged from 0.24:1 to 2.92:1, whereas the sailcloths of the present disclosure had a 1% warp to 1% fill ratio that ranged from 4.89:1 to 24:1. The comparative sailcloths also had a 1% fill to 1% bias ratio that ranged from 1.64:1 to 7.13:1, whereas the sailcloths of the present disclosure had a 1% fill to 1% bias ratio that ranged from 0.62:1 to 0.74:1. A 1% warp:1% fill to 1% fill 1% bias ratio that ranged from 0.03 to 0.96 characterized the comparative sailcloths, whereas a 1% warp:1% fill to 1% fill:1% bias ratio that ranged from 7.33:1 to 32.47:1 characterized the sailcloths of the present disclosure. The comparative sailcloths had a 10 lb. warp to 10 lb. fill ratio that ranged from 0.57:1 to 4.5:1, whereas the sailcloths of the present disclosure had a 10 lb. warp to 10 lb. fill ratio that ranged from 0.07:1 to 0.44:1. The comparative sailcloths also had a 10 lb. fill to 10 lb. bias ratio that ranged from 0.15:1 to 0.74:1, whereas the sailcloths of the present disclosure had a 10 lb. fill to 10 lb. bias ratio that ranged from 1.12:1 to 2.5:1. A 10 lb. warp:10 lb. fill to 10 lb. fill:10 lb. bias ratio that ranged from 0.76:1 to 29.2:1 characterized the comparative sailcloths, whereas a 10 lb. warp:10 lb. fill to 10 lb. fill:10 lb. bias ratio that ranged from 0.03:1 to 0.39:1 characterized the sailcloths of the present disclosure.

All patents, patent application publications, journal articles, textbooks, and other publications mentioned in the specification are indicative of the level of skill of those in the art to which the disclosure pertains. All such publications are incorporated herein by reference to the same extent as if each individual publication were specifically and individually indicated to be incorporated by reference.

The invention illustratively described herein may be suitably practiced in the absence of any element(s) or limitation(s), which is/are not specifically disclosed herein. Thus, for example, each instance herein of any of the terms "comprising," "consisting essentially of," and "consisting of" may be replaced with either of the other two terms. Likewise, the singular forms "a," "an," and "the" include plural references unless the context clearly dictates otherwise. Thus, for example, references to "the method" includes one or more methods and/or steps of the type, which are described herein and/or which will become apparent to those ordinarily skilled in the art upon reading the disclosure.

The terms and expressions, which have been employed, are used as terms of description and not of limitation. In this regard, where certain terms are defined at the beginning of the "Detailed Description" and are otherwise defined, described, or discussed elsewhere in the disclosure, all such definitions, descriptions, and discussions are intended to be attributed to such terms. There also is no intention in the use of such terms and expressions of excluding any equivalents of the features shown and described or portions thereof.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A woven sailcloth comprising warp yarns and fill yarns and having a 1% warp of at least about 125 and/or a warp efficiency of at least about 17, wherein the fill yarns are pre-crimped, and wherein the warp yarns and the fill yarns are weaved in a plain weave in which the ratio of fill yarn count to warp yarn count is about 1.1:1 to about 1.8:1 and the ratio of warp yarn density to fill yarn density is about 1.2:1 to about 1.9:1.

2. The woven sailcloth of claim 1, which also has a weight of at least about 7.

3. The woven sailcloth of claim 1, which has a 1% warp of at least about 190 and/or a warp efficiency of at least about 21.

4. The woven sailcloth of claim 3, which also has a weight of at least about 9.

5. The woven sailcloth of claim 1, which also has at least one of:

(a) a 1% warp to 1% fill ratio of at least about 4:1, (b) a 1% fill to 1% bias ratio of less than about 1:1, (c) a 1% warp:1% fill to 1% fill:1% bias ratio of at least about 1:1, (d) a 10 lb. warp to 10 lb. fill ratio of less than about 0.5:1, (e) a 10 lb. fill to 10 lb. bias ratio of at least about 1:1, and (f) a 10 lb. warp:10 lb. fill to 10 lb. fill:10 lb. bias ratio of less than about 0.5:1.

6. The woven sailcloth of claim 1, wherein the fill yarns comprise a reinforcing yarn.

7. The woven sailcloth of claim 6, wherein the reinforcing yarn is present every $n^{th}$ yarn, wherein n is an integer from and including 5 to and including 20.

8. The woven sailcloth of claim 7, wherein the fill yarns are weaved in a ripstop pattern.

9. A woven sailcloth comprising warp yarns and fill yarns weaved in a plain weave in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, wherein the woven sailcloth has a 1% warp of at least about 125 and/or a warp efficiency of at least about 17.

10. The woven sailcloth of claim 9, which has a weight of at least about 7.

11. The woven sailcloth of claim 9, which has a 1% warp of at least about 190 and/or a warp efficiency of at least about 21.

12. The woven sailcloth of claim 11, which has a weight of at least about 9.

13. The woven sailcloth of claim 9, which has at least one of:

(a) a 1% warp to 1% fill ratio of at least about 4:1,
(b) a 1% fill to 1% bias ratio of less than about 1:1,
(c) a 1% warp:1% fill to 1% fill:1% bias ratio of at least about 1:1,
(d) a 10 lb. warp to 10 lb. fill ratio of less than about 0.5:1,
(e) a 10 lb. fill to 10 lb. bias ratio of at least about 1:1, and
(f) a 10 lb. warp:10 lb. fill to 10 lb. fill:10 lb. bias ratio of less than about 0.5:1.

14. The woven sailcloth of claim 9, wherein the fill yarns comprise a reinforcing yarn.

15. The woven sailcloth of claim 14, wherein the reinforcing yarn is present every $n^{th}$ yarn, wherein n is an integer from and including 5 to and including 20.

16. The woven sailcloth of claim 15, wherein the fill yarns are weaved in a ripstop pattern.

17. A woven sailcloth comprising warp yarns and fill yarns having a weight of at least about 7, wherein the fill yarns are pre-crimped, and wherein the warp yarns and the fill yarns are weaved in a plain weave in which the ratio of fill yarn count to warp yarn count is about 1.1:1 to about 1.8:1 and the ratio of warp yarn density to fill yarn density is about 1.2:1 to about 1.9:1, and having at least one of:

(a) a 1% warp to 1% fill ratio of at least about 4:1,
(b) a 1% fill to 1% bias ratio of less than about 1:1,
(c) a 1% warp:1% fill to 1% fill:1% bias ratio of at least about 1:1,
(d) a 10 lb. warp to 10 lb. fill ratio of less than about 0.5:1,
(e) a 10 lb. fill to 10 lb. bias ratio of at least about 1:1, and
(f) a 10 lb. warp:10 lb. fill to 10 lb. fill:10 lb. bias ratio of less than about 0.5:1.

18. The woven sailcloth of claim 17, which has a 1% warp of at least about 125 and/or a warp efficiency of at least about 17.

19. The woven sailcloth of claim 17, which has a 1% warp of at least about 190 and/or a warp efficiency of at least about 21.

20. The woven sailcloth of claim 19, which has a weight of at least about 9.

21. The woven sailcloth of claim 17, wherein the fill yarns comprise a reinforcing yarn.

22. The woven sailcloth of claim 21, wherein the reinforcing yarn is present every $n^{th}$ yarn, wherein n is an integer from and including 5 to and including 20.

23. The woven sailcloth of claim 22, wherein the fill yarns are weaved in a ripstop pattern.

24. A woven sailcloth having a weight of at least about 7 and comprising warp yarns and fill yarns in which the ratio of fill yarn count to warp yarn count is about 1.1:1 to about 1.8:1 and the ratio of warp yarn density to fill yarn density is about 1.2:1 to about 1.9:1, wherein the fill yarns are pre-crimped, and wherein the woven sailcloth has a 1% warp of at least about 125, a warp efficiency of at least about 17, a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1.

25. The woven sailcloth of claim 24, which the weight of the sailcloth is at least about 9, the 1% warp is at least about 190 and the warp efficiency is at least about 21.

26. A sail comprising at least one panel of the woven sailcloth of claim 24, wherein the at least one panel of the woven sailcloth is assembled into the sail with load paths oriented along its warp yarns.

27. A sail comprising at least one panel of the woven sailcloth of claim 25, wherein the at least one panel of the woven sailcloth is assembled into the sail with load paths oriented along its warp yarns.

28. A sail comprising at least one panel of the woven sailcloth of claim 9, wherein the at least one panel of the woven sailcloth is assembled into the sail with load paths oriented along its warp yarns.

29. A sail comprising at least one panel of the woven sailcloth of claim 10, wherein the at least one panel of the woven sailcloth is assembled into the sail with load paths oriented along its warp yarns.

30. A sail comprising at least one panel of the woven sailcloth of claim 11, wherein the at least one panel of the woven sailcloth is assembled into the sail with load paths oriented along its warp yarns.

31. A sail comprising at least one panel of the woven sailcloth of claim 12, wherein the at least one panel of the woven sailcloth is assembled into the sail with load paths oriented along its warp yarns.

32. A sail comprising at least one panel of the woven sailcloth of claim 13, wherein the at least one panel of the woven sailcloth is assembled into the sail with load paths oriented along its warp yarns.

33. A sail comprising at least one panel of the woven sailcloth of claim 17, wherein the at least one panel of the woven sailcloth is assembled into the sail with load paths oriented along its warp yarns.

34. A sail comprising at least one panel of the woven sailcloth of claim 18, wherein the at least one panel of the woven sailcloth is assembled into the sail with load paths oriented along its warp yarns.

35. A sail comprising at least one panel of the woven sailcloth of claim 19, wherein the at least one panel of the woven sailcloth is assembled into the sail with load paths oriented along its warp yarns.

36. A sail comprising at least one panel of the woven sailcloth of claim 20, wherein the at least one panel of the woven sailcloth is assembled into the sail with load paths oriented along its warp yarns.

37. A method of making a woven sailcloth comprising warp yarns and fill yarns, which method comprises weaving warp yarns and fill yarns in a plain weave in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, whereupon a woven sailcloth comprising warp yarns and fill yarns is made.

38. The method of claim 37, wherein the fill yarns comprise a reinforcing yarn.

39. The method of claim 38, wherein the reinforcing yarn is present every $n^{th}$ yarn, wherein n is an integer from and including 5 to and including 20.

40. The method of claim 39, wherein the fill yarns are weaved in a ripstop pattern.

41. A method of making a sail, which method comprises assembling panels of sailcloth comprising warp yarns and fill yarns in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, wherein (i) at least one panel of sailcloth has a 1% warp of at least about 125 and/or a warp efficiency of at least about 17 and (ii) the at least one panel of sailcloth is assembled into the sail with load paths oriented along its warp yarns, whereupon a sail is made.

42. The method of claim 41, wherein the at least one panel of sailcloth has a 1% warp of at least about 190 and/or a warp efficiency of at least about 21.

43. The method of claim 41, wherein the at least one panel of sailcloth also has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1.

44. A method of making a sail, which method comprises assembling panels of sailcloth, at least one panel of which is woven sailcloth comprising warp yarns and fill yarns weaved in a plain weave in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, wherein the woven sailcloth has a 1% warp of at least about 125 and/or a warp efficiency of at least about 17, whereupon a sail is made.

45. The method of claim 44, wherein the woven sailcloth has a weight of at least about 7.

46. The method of claim 44, wherein the woven sailcloth has a 1% warp of at least about 190 and/or a warp efficiency of at least about 21.

47. The method of claim 46, wherein the woven sailcloth has a weight of at least about 9.

48. The method of claim 44, wherein the woven sailcloth has at least one of:

(a) a 1% warp to 1% fill ratio of at least about 4:1,
(b) a 1% fill to 1% bias ratio of less than about 1:1,
(c) a 1% warp:1% fill to 1% fill:1% bias ratio of at least about 1:1,
(d) a 10 lb. warp to 10 lb. fill ratio of less than about 0.5:1,
(e) a 10 lb. fill to 10 lb. bias ratio of at least about 1:1, and
(f) a 10 lb. warp:10 lb. fill to 10 lb. fill:10 lb. bias ratio of less than about 0.5:1.

49. A method of making a sail, which method comprises assembling panels of sailcloth having a weight of at least about 7 comprising warp yarns and fill yarns in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, wherein (i) at least one panel of sailcloth has at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, a 10 lb. warp:10 lb. fill to 10 lb. fill:10 lb. bias ratio of less than about 0.5:1 and (ii) the at least one panel of sailcloth is assembled into the sail with load paths oriented along its warp yarns, whereupon a sail is made.

50. The method of claim 49, wherein the at least one panel of sailcloth also has a 1% warp of at least about 125 and/or a warp efficiency of at least about 17.

51. The method of claim 49, wherein the at least one panel of sailcloth also has a 1% warp of at least about 190 and/or a warp efficiency of at least about 21.

52. A method of making a sail, which method comprises assembling panels of sailcloth, at least one of which is a panel of woven sailcloth having a weight of at least about 7 and comprising warp yarns and fill yarns weaved in a plain weave in which the fill yarns are pre-crimped, and in which the ratio of fill yarn count to warp yarn count is about 1.1:1 to about 1.8:1 and the ratio of warp yarn density to fill yarn density is about 1.2:1 to about 1.9:1, wherein the woven sailcloth has a 1% warp of at least about 125, a warp efficiency of at least about 17, and at least one of a 1% warp to 1% fill ratio of at least about 4:1, a 1% fill to 1% bias ratio of less than about 1:1, a 1% warp:1% fill to 1% fill:1% bias ratio of at least about 1:1, a 10 lb. warp to 10 lb. fill ratio of less than about 0.5:1, a 10 lb. fill to 10 lb. bias ratio of at least about 1:1, and a 10 lb. warp:10 lb. fill to 10 lb. fill:10 lb. bias ratio of less than about 0.5:1, whereupon a sail is made.

53. The method of claim 52, wherein the weight of the woven sailcloth is at least about 9, the 1% warp is at least about 190 and the warp efficiency is at least about 21.

* * * * *